US005170313A

United States Patent [19]

Miller et al.

[11] Patent Number: 5,170,313

[45] Date of Patent: Dec. 8, 1992

[54] TIMED CONTACT SWITCH

[75] Inventors: James P. Miller, Freeport; Ronald G. Cox, Cedarville; John E. Wardrop, Freeport, all of Ill.

[73] Assignee: Honeywell Inc., Minneapolis, Minn.

[21] Appl. No.: 632,308

[22] Filed: Dec. 21, 1990

[51] Int. Cl.[5] ..... H01H 47/18

[52] U.S. Cl. ..... 361/179; 361/196

[58] Field of Search ..... 307/10.7, 10.8, 141, 307/141.4, 141.8, 142, 143; 361/189, 190, 195, 196; 324/207.2; 340/815; 200/522, 530, 532, 534, 535

[56] References Cited

U.S. PATENT DOCUMENTS

| | | | |
|---|---|---|---|
| 3,593,235 | 7/1971 | Nicol | 335/186 |
| 3,920,149 | 12/1975 | Fortino et al. | 222/1 |
| 4,064,381 | 12/1977 | Mullen et al. | 200/16 A |
| 4,276,483 | 6/1981 | Hayden | 307/10 R |
| 4,450,987 | 5/1984 | Boettcher et al. | 222/641 |
| 4,467,219 | 8/1984 | Reid | 307/10 |
| 4,714,977 | 12/1987 | Hoelzer | 361/196 |
| 5,107,237 | 4/1992 | Peterson | 335/170 |

*Primary Examiner*—A. D. Pellinen
*Assistant Examiner*—Michael A. Friedhofer
*Attorney, Agent, or Firm*—Edward Schwarz

[57] ABSTRACT

A timed contact switch apparatus has a conventional pushbutton placing a main switch in an actuated state when the pushbutton is depressed. A timing circuit is activated by the pushbutton to provide power to activate an electromechanical latch which holds the main switch in its actuated state while the timing circuit times out. Preferably the timing circuit operation is initiated by output of a Hall sensor which is controlled by a magnet whose position is mechanically linked to the position of the pushbutton.

10 Claims, 2 Drawing Sheets

TIMED CONTACT SWITCH

BACKGROUND OF THE INVENTION

This invention is a particular design of a timed contact manually operated switch. By "timed contact switch" is meant a switch which when actuated by a user, retains its actuated condition for a predetermined time period. Certain types of such switches incorporate mechanical with a timing element which actuates the contacts for the time period. Of course, such a switch need not be one which, when actuated has conduction between terminals of the switch for the period of time, but may be one for which conduction is interrupted during the time period. These switches have use in various applications, such as controlling power to defroster apparatus, lights, etc.

There have been any number of different designs for these timed contact switches. Some use a bimetal strip which is slowly heated by current passing through a resistance element within the unit, and which breaks (changes) the contact when a certain temperature is reached. Others use a slowly operating fluid dashpot in combination with a mechanical spring which after a period of time restores the switch to its normal condition. There are certain applications however, where high reliability is necessary and where the unit's "on" time period must be independent of temperature and pressure. These may arise in safety critical operations such as in aircraft, furnace controls, etc.

Valve control mechanisms having some resemblance to the apparatus of this invention have been used for controlling liquid dispensing on a timed basis in, for example, vending machines. Indeed, these devices constitute the best art of which applicants are aware. The resemblance arises from the use in both of a winding to which flow of power is controlled by a timing circuit.

BRIEF DESCRIPTION OF THE INVENTION

The timed contact switch apparatus forming the subject of this invention is powered by an external DC source. This switch includes a housing and a manually actuated pushbutton mounted on the housing for movement between first and second positions as manual force is applied, and in this regard this switch is conventional. The term pushbutton will be used extensively hereafter. Applicants wish the term not be interpreted to mean a pushbutton only, but to also include elements such as levers, knobs, thumb wheels, handles, and any other element suitable for manually actuating a switch. The switch includes a spring urging the pushbutton toward its first position. There is also a main electrical switch, typically of conventional design, within the housing whose conduction state is controlled by an actuator thereon having first and second positions. The actuator of this main switch is biased by an actuator spring toward its first position. The actuator further is in operative communication with the pushbutton and urged toward its second position by movement of the pushbutton toward its second position. By "operative communication", we mean simply that actuating the pushbutton from its first to its second position causes the main switch actuator to change the main switch's conduction state.

One novel aspect of this timed contact switch is an electrically activated latch including a winding and a ferromagnetic armature. The armature is interposed between the pushbutton and the main switch actuator to transmit force from the pushbutton to the actuator. It is convenient to think of the latch's armature as having first and second positions corresponding to the pushbutton's first and second positions. Responsive to a latch current, the winding provides magnetic attraction for the armature sufficient to maintain the armature and the actuator in their second positions and to overcome the actuator spring force biasing the actuator to its first position. However, the winding and armature design, as well as that of the source of the winding current, is such that, acting alone, they are incapable of shifting the armature from its first to its second position against the actuator spring force.

There is also an auxiliary switch having first and second conductive states, and mechanically controlled by the pushbutton to its first and second states corresponding to the first and second positions of the pushbutton. The auxiliary switch receives a DC voltage from the external source and provides a first output voltage level responsive to the first auxiliary switch conductive state and a second output voltage level otherwise. In our preferred embodiment, this auxiliary switch comprises a Hall sensor receiving DC power and a magnet whose position relative to the Hall sensor is controlled by the pushbutton to thereby switch the Hall sensor output and provide these output voltage levels.

A latch operating circuit receives DC power from the external source and has a power control element which gates latch current from the external source to the latch's winding responsive to a closure signal. The latch operating circuit also has a timing element receiving the output voltage levels from the auxiliary switch and providing the closure signal to the power control element for a predetermined time period responsive to and beginning with the appearance of the second output voltage level from the auxiliary switch. It can thus be seen that when the pushbutton is actuated, the main switch actuator moves to its second position and the auxiliary switch provides the second voltage to the timing element of the latch operating circuit. While the timing element predetermined time period elapses, the main switch actuator maintains its second position and the main switch its corresponding conduction state.

Accordingly, one purpose of this invention is to reliably maintain a momentary contact switch in its abnormal conductive condition for a predetermined time period to thereby allow it to function as a timed contact switch.

A second purpose of the invention is to allow the predetermined time period to be reset at any time during the abnormal conductive condition by again manipulating the pushbutton.

Another purpose of the invention is to allow the momentary contact switch to be used without the timed contact feature in case of that feature's failure.

Yet another purpose is to provide the timed switch contact control by use of external DC power for the timing and control elements of the switch.

A further purpose is to provide a timed contact switch which is relatively insensitive to ambient temperature.

Yet another purpose is to completely avoid the use of electromechanical components in establishing the switch's on time period.

Other purposes of this invention will become apparent upon study of the description which follows.

DESCRIPTION OF THE PREFERRED EMBODIMENTS

Figure 1:
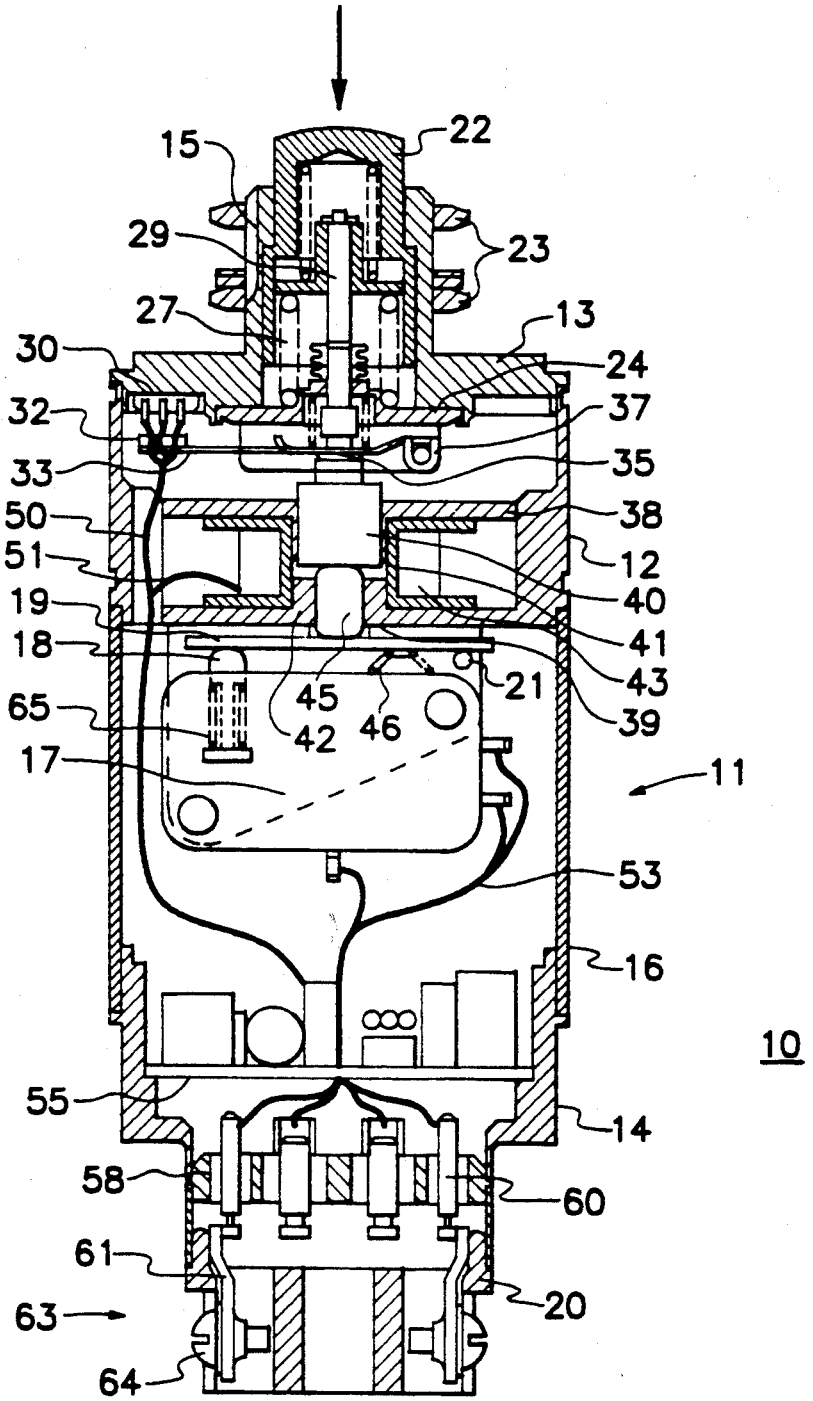
FIG. 1 is a section view of the invention showing its mechanical features.

Referring first to FIG. 1, the timed contact switch 10 shown in section view therein includes a number of conventional features. These include a housing 11 within which the various elements of the invention are mounted. A conventional main switch 17 actually controls the electrical current whose flow is to occur (or be interrupted) for the period of time set for the switch 10. The conductive state of switch 17 is controlled by a plunger 18 which has a first position as shown in FIG. 1 and a second position with the plunger 18 shifted downwardly from the position shown in FIG. 1. A compression spring 65 constantly urges plunger 18 toward its first position. Plunger 18 in its second position actuates the internal mechanism of switch 17 to a conductive state different from that arising from plunger 18 in its first position. By analogy to relays where the conduction state of the contacts when the winding is unpowered is referred to as "normal", e.g. normally open or normally closed, the conductive state of switch 17 with plunger 18 in its first position will be referred to hereafter as normal, and that with the plunger in its second position will be referred to as abnormal. Plunger 18 is operated by an actuator 19 having the form of a lever shown mounted at a first end for rotation about pivot shaft 21. Second end of actuator 19 transmits force to plunger 18 to shift plunger 18 to its second position thereby operating the internal mechanism of the switch 17 and placing switch 17 in its abnormal conductive state. In certain designs it may be advantageous to also mount a spring 46 on actuator 19 to contact the body of switch 17 thus assuring that actuator 19 returns to its first position when no force is applied to it.

The housing 11 which encloses and mounts the elements of the invention includes a barrel portion 16, top extension 12, top end 13, bottom extension 14, and bottom end 20, all of which are bonded together during manufacture by some appropriate adhesive. There is a projecting cylinder on top end 13 which has external threads for engaging mounting nuts 23 by which the switch 10 may be mounted on a panel plate, not shown. The entire housing 11 as well as the internal components shown as being symmetrical can be thought of as having a single central axis which bilaterally intersects the entire switch 10 and the symmetrical components. A portion of this axis is shown below the switch 10 in FIG. 1.

The internal mechanisms of switch 10 are operated by a user who presses on a pushbutton 22 mounted for sliding along the central axis within the projecting cylinder on top end 13 to cause its movement as indicated by the adjacent arrow. A spring 27 holds pushbutton 22 in what will be called a first position where the pushbutton 22 extends outside of housing 11 to the maximum limit possible as controlled by stops internal to the cylinder on top end 13. When pressed, pushbutton 22 shifts downwardly as viewed in FIG. 1 to a second position, compressing spring 27. Pushbutton 22 includes an internal shaft 29 which extends downwardly along the central axis within pushbutton 22 to contact a ferromagnetic armature 40 and contact and support a magnet carrier 33. Magnet carrier 33 comprises a cantilever member mounted within housing 10 to a pivot 37 at a first end for rotation, and at a second end carries a magnet 32. Thus as pushbutton 22 is pressed, magnet 33 moves downwardly and as pushbutton 22 is released, magnet 33 moves upwardly again under the influence of spring 27. Movement of pushbutton 22 also causes armature 40 to shift downwardly. A connecting link 45 beneath armature 40 carries force from pushbutton 22 to the actuator 19 and allows pushbutton 22 to control the conductive state of switch 17.

Magnet 32 controls the output of a Hall sensor element 30 which as is well known provides a voltage responsive to a change in the magnetic field enveloping the element. The voltage output from sensor 30 as well as the input power for sensor 30 is carried by the individual conductors of a cable 50. For purposes of understanding this invention's operation, one can consider the Hall element sensor 30 as having a first state corresponding to the magnet 32 position resulting from the first position of the pushbutton 22 and a second state corresponding to the magnet 32 position resulting from the pushbutton's second position. Sensor 30 provides first and second output voltage levels responsive to the first and second states of the Hall sensor element 30. There are a number of Hall sensor elements and associated magnets available from various vendors which are suitable for use in this device. The proximity of the magnet 32 from sensor 30 when pushbutton 22 is in its first position should be set so that the sensor 30 switches from its first to its second state approximately midway in the movement of pushbutton 22 from its first to its second position.

The ferromagnetic armature 40 is supported and guided for sliding translation along the central axis by a ferromagnetic top pole piece 38. Pole piece 38 fits on top of and extends part way into a central opening of a bobbin 41 on which is wound a winding 43. A ferromagnetic bottom pole piece 39 fits under bobbin 41 and has passing completely through it, a central opening whose axis is aligned with the central axis. The bottom pole piece 39 includes an annular collar 42 projecting into the central opening of bobbin 41 to a predetermined position as shown adjacent armature 40. A non-magnetic connecting link 45 is guided and supported by the central opening of bottom pole piece 39 and allows force provided by pushbutton 22 to armature 40 to reach actuator 19 and actuate switch 17. The top surface of collar 42 is located so that armature 40 contacts collar 42 only when actuator 19 has changed the conduction state of switch 17. Cabling 51 carries current to winding 43.

A printed circuit board 55 mounted within housing 11 carries the electronic components required for this switch. The cables 50 and 51 connect Hall sensor element 32 and winding 43 to circuit elements carried on board 55. While the electronic portion of the switch will be discussed in detail in connection with FIGS. 2 and 3, it should be noted that the external source of DC power is received by the components carried on the printed circuit board 55.

Electrical communication between the external world and switch 10 is via a connector block 58 mounted in extension 14 and a screw terminal block 63 mounted in bottom end 20. Connector block 58 has individual connectors 60 fixed in it to which cable 50 and 51 conductors are connected. Lead 61 and those similar to it connect individual connectors 60 to screw terminals 64. Of course; there are many other ways to connect this switch to some external device.

Figure 2:
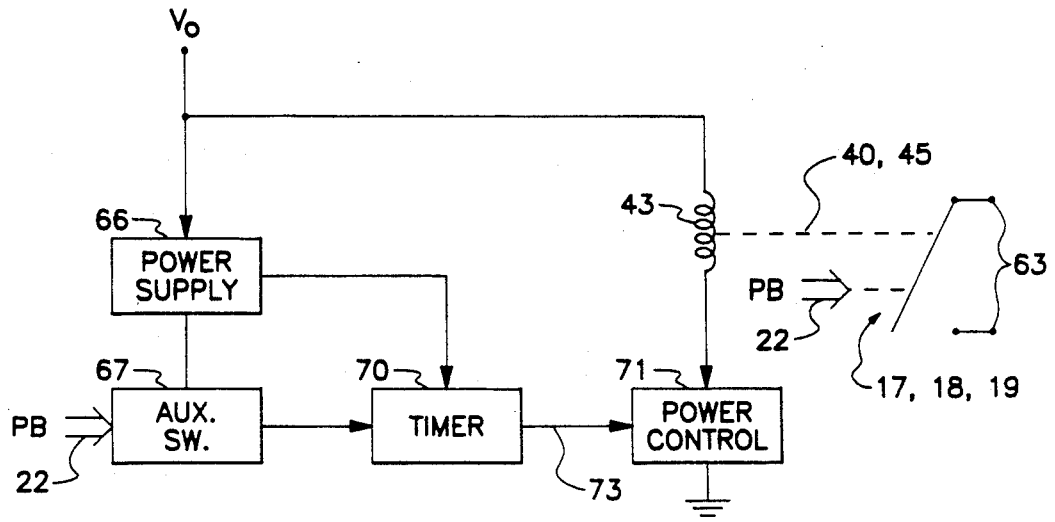
FIG. 2 is a block diagram of the circuit of the timed contact switch.

To understand the operation of this switch 10 it is necessary to also understand the operation of the electronic circuitry carried on printed circuit board 55. This can most easily be accomplished by considering FIG. 2 which is a block diagram of the circuitry on board 55. In the apparatus of FIG. 2, a power supply 66 receives unregulated DC power from an external source shown symbolically as Vo. The circuitry uses two different voltage levels, +6 v. and +12 v., which are generated by power supply 66. Distribution of these DC voltages is symbolized by the lines extending from power supply 66.

An auxiliary switch 67 is symbolically shown as receiving a mechanical input from pushbutton 22. The auxiliary switch 67 provides a first output voltage level when pushbutton 22 is not being pushed, and a second output voltage level different from the first when pushbutton 22 is pushed.

A timer 70 and a power control 71 comprise a latch operating circuit which controls flow of current to winding 43. Timer 70 receives the output voltage levels from switch 67, and responds to each instance of a change from the first to the second output voltage level from the auxiliary switch 67 by starting to time an interval of predetermined length and by placing a closure signal on path 73. When the interval has expired, the closure signal is removed from path 73. Power control element 71 receives the closure signal on path 73, and provides current energizing winding 43 while the closure signal is present. When the interval which timer 70 is timing has expired, the closure signal ends, and power control drops the current to winding 43.

A dotted line in FIG. 2 drawn between a switch symbol and winding 43, has ref. nos. 40, 45 to symbolize a mechanical connection provided by the armature 40 and connecting link 45 between the magnetic force generated by winding 40 and switch 17. The switch symbol shown in FIG. 2 has ref. nos. 17, 18, 19 attached to it to symbolize that switch 17, plunger 18, and actuator 19 are all present in the diagram of FIG. 2. A mechanical link from pushbutton 22 to switch 17 is also shown in FIG. 2, and symbolizes that pushbutton 22, when depressed, places switch 17 in its abnormal conductive state. As represented in FIG. 2, the external device for which current flows through switch 17 is electrically connected to switch 17 by terminals 63. When pushbutton 22 is depressed and timer 70 provides its closure signal to power control 71, the magnetic force generated by winding 43 is applied via armature 40 and connecting link 45 to the actuator 19. This magnetic force is sufficient to hold armature 40 in its second position with its bottom face contacting the top face of the bottom pole piece's collar 42 within the opening through winding 40. The top and bottom pole pieces 38 and 39 along with the armature 40 complete a magnetic circuit when armature 40 is in its second position in contact with bottom pole piece 39, allowing armature 40 to be held in its second position with relatively small current flow in winding 43 and through power control 71.

It is important that armature 40 and bottom pole piece 39 be selected from a ferromagnetic material which has very little remanence, so there is no residual magnetism in these elements when current is not flowing in winding 43. Such residual magnetism could conceivably over come the restoring force from spring 65, preventing armature 40 from returning to its first position when current flow ceases in winding 43 and consequently holding switch 17 in its abnormal conductive state.

Figure 3:
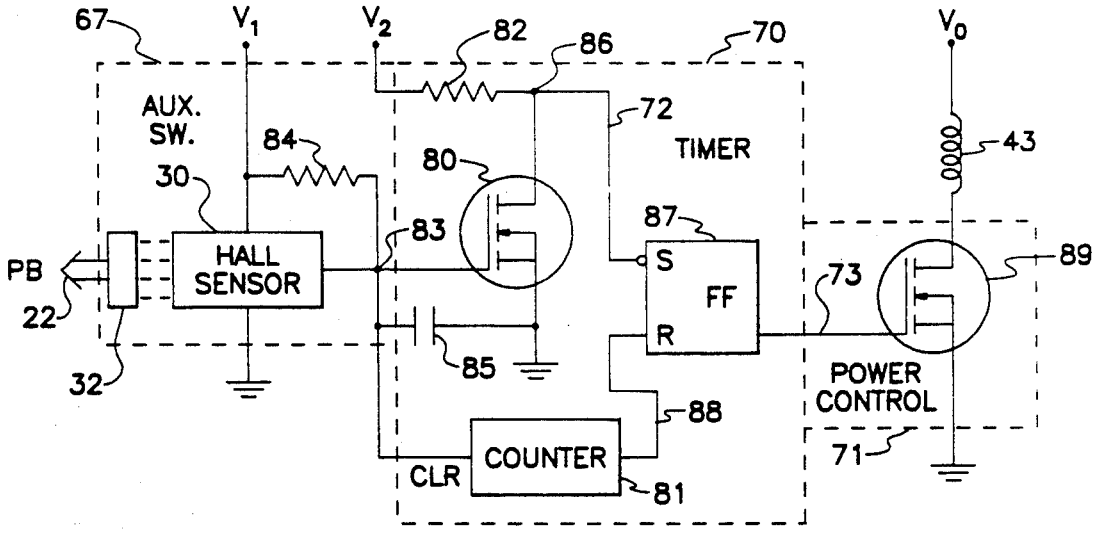
FIG. 3 is a combined block and circuit diagram of a preferred embodiment of the timed contact switch.

FIG. 3 shows additional detail of the circuit of FIGS. 1 and 2. In the preferred embodiment, the auxiliary switch 67 comprises a Hall sensor element 30 which receives voltage $V_1$, +12 v. in a preferred embodiment, from power supply 66. The representation in FIG. 3 is intended to symbolize that depressing pushbutton 22 moves magnet 32 away from sensor 30, as is also explicitly shown in FIG. 1. The voltage forming the output of sensor 30 is provided to a circuit junction 83 which is also connected to the $V_1$ voltage source by a resistor 84. While the magnet 32 is adjacent to sensor 30, the output from sensor 30 applied to junction 83 is a relatively low voltage. Whenever pushbutton 83 is depressed, magnet 32 is moved away from sensor 30, and its output voltage at junction 83 changes from a relatively low voltage to a higher voltage. The sensor 30 along with first resistor 84 comprise in FIG. 3 the auxiliary switch 67 shown in FIG. 2. The voltage output of switch 67 is provided at junction 83.

The voltage at junction 83 is the input signal provided by auxiliary switch 67 to timer 70. Within timer 70 a field effect transistor (FET) 80 and a counter 81 receive the output of switch 67. FET 80 serves as an interface and inverter for the voltage output at junction 83 from sensor 30. The drain electrode of FET 80 is connected at junction 86 by a second resistor 82 to a source for a voltage $V_2$ which is lower than $V_1$, and which in our preferred embodiment is +6 v. The source electrode of FET 80 is connected to ground. A small capacitor 85 connects the gate of FET 80 to its source electrode to filter noise pulses which may occasionally be present in the Hall element output. FET 80 is of the type which is cut off when its gate voltage is low, so that while pushbutton 22 is not depressed and magnet 32 is adjacent sensor 30, the low voltage at junction 83 cuts off FET 80 and the voltage at junction 86 is relatively high. Whenever the pushbutton 22 is depressed causing magnet 32 to move away from sensor 30, the voltage at junction 83 rises and FET 80 conducts. This pulls down the voltage at junction 86 for so long as pushbutton 22 is depressed. One can thus see that FET 80 serves as a voltage inverter by providing a low voltage at junction 83 when the voltage at junction 86 is high, and vice versa. FET 80 serves its interface function by rescaling the output of sensor 30 to be compatible with the logic levels required by other elements in the circuit.

Timer 70 may be one of the type which increments the contents of an internal counter 81 at a predetermined rate. When this contents reaches a predetermined value, a short positive-going output pulse is provided as output on connector 88. The contents of counter 81 are cleared to zero each time a high voltage level is provided at its input from junction 83. This predetermined value is thus reached at the end of a predetermined time interval after the magnet 32 is moved away from sensor 30. Thus the output pulse from counter 81 is provided at the end of such a predetermined time interval starting when the pushbutton 22 is depressed. In our current embodiment, the predetermined time interval is 2¼ minutes, but any interval can be easily selected by simply changing either the counting rate of counter 81, or changing the predetermined value in the counter at which the positive-going pulse is provided. Because the size of the components which control the counting rate increase with decreasing rate, it is preferred to increase capacity of counter 81 rather than decrease counting rate if a longer time interval is required. Large components are undesirable because crowding of components within the housing 11 complicates the manufacturing process and may require increasing the size of the housing 11.

Note that counter 81 is reset each time pushbutton 22 is depressed, so that the switch 17 returns to its normal condition only at the end of the predetermined time interval after the last time the pushbutton 22 wa depressed.

The voltage at junction 86 is provided to the S (set), inverting input of a flip-flop 87, and the output of counter 81 on connector 88 is provided to the R (reset), non-inverting input of flip-flop 87. The inverting feature at the S input of flip-flop 87 is symbolized by the small circle where the input from junction 86 is received. Flip-flop 87 is of the type which provides either a logical 1 or a logical 0 output on connector 73 dependent on the latest input received at the S and R inputs. The output of flip-flop 87 on connector 73 is dependent on the previous input voltages received at the S and R inputs, according to the following truth table:

| S | R | Output |
|---|---|---|
| Low | Low | High |
| Low | High | Indeterminate |
| High | Low | Unchanged |
| High | High | Low |

One can see by inspection of this table that when pushbutton 22 is depressed so that magnet 32 is spaced from sensor 30 and the voltage at junction 86 is low, flip-flop 87 provides a high voltage on connector 73. After the magnet 32 returns to its normal position with the pushbutton 22 released, the output of flip-flop 87 remains unchanged. Only when counter 84 counts to its predetermined value and provides the positive-going pulse on connector 88 does the output of flip-flop 87 change to a low voltage. Thus, the output of flip-flop 87 is a low voltage except for the predetermined time interval after each time the pushbutton 22 is depressed.

The power control element 71 in this preferred embodiment comprises an N type FET 89 which conducts when the voltage at its gate on connector 73 from flip-flop 87 is high. FET 89 must be of the type having very low impedance when conducting so as to reduce the heat generated within the switch housing 11. One suitable transistor is available from Motorola Inc., Phoenix, Ariz., Model No. MTD3055E, which has an "on" impedance of 0.10 to 0.15 ohm.

While the above describes our currently preferred embodiment, there are any number of variations which are possible. Just to mention a few, sensor 30 need not be a Hall element, but could be a reed switch or other type of mechanical switch. The design of the timer 70 can have a wide range of characteristics as well.

What we wish to claim by letters patent is:

1. In a timed contact switch apparatus of the type receiving DC power from an external source, and including a housing, a manually actuated pushbutton mounted on the housing for movement between first and second positions, a spring urging the pushbutton toward its first position, and a main electrical switch within the housing whose conduction state is controlled by an actuator thereon having first and second positions, said actuator biased by an actuator spring toward its first position, and said actuator further in operative communication with the pushbutton and urged toward its second position by movement of the pushbutton toward its second position, said main switch changing conduction state as the actuator moves between its first and second positions, the improvement comprising:

a) an electrically activated latch including a winding and a ferromagnetic armature, said armature interposed to transmit force from the pushbutton to the actuator and having first and second positions corresponding to the pushbutton's first and second positions, said winding providing responsive to a latch current in the winding, magnetic attraction for the armature sufficient to maintain the armature and the actuator in their second positions and to overcome the actuator spring force biasing the actuator to its first position;

b) an auxiliary switch having first and second conductive states, and mechanically controlled by the pushbutton to its first and second states corresponding to the first and second positions of the pushbutton, and electrically receiving a DC voltage from the external source and providing a first output voltage level responsive to the auxiliary switch first conductive state and a second output voltage level otherwise; and c) a latch operating circuit receiving DC power from the external source and having a power control element gating latch current from the external source to the latch's winding responsive to a closure signal, and a timing element receiving the output voltage levels from the auxiliary switch and providing the closure signal to the power control element for a predetermined time period responsive to and beginning with the appearance of the second output voltage level from the auxiliary switch.

2. The timed contact switch apparatus of claim 1, wherein the auxiliary switch comprises a Hall effect element receiving power from the external source; a magnet; a magnet carrier mounted in the housing on which is mounted the magnet, said magnet carrier mechanically connected to the pushbutton and moving therewith to move the magnet between a first position adjacent the Hall effect element and corresponding to the first position of the pushbutton and a second position spaced from the Hall effect element and corresponding to the second position of the pushbutton; and a power switching circuit receiving the voltage output of the Hall effect element and voltage from the external source, and supplying voltage to the timing element of the latch operating circuit responsive to the second position of the magnet and removing said voltage from the timing element responsive to the first position of the magnet, and wherein the timing element receives power from which the closure signal is derived directly from the external source.

3. The timed contact switch apparatus of claim 2, wherein the magnet carrier comprises within the housing a cantilevered beam mounted at one end for rotation and extending transverse to the path of motion of the pushbutton and in mechanical engagement with the pushbutton, and carrying the magnet at its unmounted end.

4. The timed contact switch apparatus of claim 1, wherein the latch's winding comprises a toroid having a central aperture, and wherein the armature is mounted for translation within the winding's central aperture.

5. The timed contact switch apparatus of claim 4, wherein the housing is a circular cylinder and has an axis, and the pushbutton is mounted at an end of the housing to shift along the housing axis, and the latch's winding has an axis and an outside diameter less than the inside diameter of the housing, and including mounting means for supporting the winding within the housing with the axis of the winding aligned with the axis of the housing.

6. The timed contact switch apparatus of claim 5, wherein the mechanical connection between the pushbutton and the armature comprises facing surfaces on each, said surfaces contacting each other when the pushbutton is moved from its first to its second position.

7. The timed contact switch apparatus of claim 6, further comprising a link shiftable along the housing's axis between the armature and the actuator of the main switch.

8. The timed contact switch apparatus of claim 1, including a first ferromagnetic pole piece surrounding the armature and guiding the movement thereof.

9. The timed contact switch apparatus of claim 8, wherein the winding has an opening extending completely through it, and the armature extends part way into the opening of the winding, and including a second ferromagnetic pole piece having a collar extending part way into the winding opening and the end of which faces the end of the armature, the spatial relationship between the armature, main switch, and second pole piece allowing contact between the armature when in its second position and the end of the second pole piece's collar.

10. The timed contact switch apparatus of claim 1, wherein the winding has a design such that when receiving the latch current, the winding generates magnetic force insufficient to shift the armature from its first to its second position against the actuator spring force.

* * * * *